US011098730B2

(12) United States Patent
Mazur

(10) Patent No.: US 11,098,730 B2
(45) Date of Patent: Aug. 24, 2021

(54) DESWIRLER ASSEMBLY FOR A CENTRIFUGAL COMPRESSOR

(71) Applicant: Rolls-Royce Corporation, Indianapolis, IN (US)

(72) Inventor: Steven Mazur, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 110 days.

(21) Appl. No.: 16/382,398

(22) Filed: Apr. 12, 2019

(65) Prior Publication Data

US 2020/0325911 A1 Oct. 15, 2020

(51) Int. Cl.

*F04D 29/44* (2006.01)
*F04D 21/00* (2006.01)
*F04D 17/10* (2006.01)

(52) U.S. Cl.

CPC ..... *F04D 29/444* (2013.01); *F04D 17/10* (2013.01); *F04D 21/00* (2013.01); *F05D 2220/32* (2013.01); *F05D 2220/3219* (2013.01); *F05D 2240/12* (2013.01); *F05D 2250/52* (2013.01); *F05D 2250/71* (2013.01)

(58) Field of Classification Search

CPC ..... F04D 29/444; F04D 29/441; F04D 17/10; F04D 17/12; F04D 21/00

See application file for complete search history.

(56) References Cited

U.S. PATENT DOCUMENTS 2,419,669 A * 4/1947 Birmann ..... F04D 17/122 415/208.4
2,609,141 A 9/1952 George
2,662,553 A 12/1953 Albert
(Continued)

FOREIGN PATENT DOCUMENTS

EP 2123863 A1 11/2009
FR 2922939 5/2009
(Continued)

OTHER PUBLICATIONS

Wilkosz, B., et al., "Numerical and Experimental Comparison of a Tandem and Single Vane Deswirler Used in an Aero Engine Centrifugal Compressor", Institute of Jet Propulsion and Turbomachinery, Journal of Turbomachinery, Apr. 2014, vol. 136, 10pgs.

(Continued)

*Primary Examiner* — Igor Kershteyn
*Assistant Examiner* — Topaz L. Elliott
(74) *Attorney, Agent, or Firm* — Barnes & Thornburg LLP

(57) ABSTRACT

A diffuser assembly is disclosed for conditioning the effluent of a centrifugal compressor. The diffuser assembly comprises an annular conduit, a first set of vanes, and a second set of vanes. The annular conduit comprises a first wall and a second wall displaced from each other and cooperating to define an inlet, an outlet, and a passage extending from the inlet to the outlet. The passage has a first linear portion, a curved portion, and a second linear portion. The first set of vanes are positioned in the first linear portion of said passage. The second set of vanes are positioned in the curved portion of the passage. Each vane of the second set of vanes curves axially and laterally from a vane leading edge to a vane trailing edge.

18 Claims, 6 Drawing Sheets

(56) References Cited

U.S. PATENT DOCUMENTS 2,681,760 A * 6/1954 Lundquist ..... F04D 29/444 415/208.3
2,900,126 A * 8/1959 Dangerfield ..... F04D 29/441 415/208.3
2,967,013 A 1/1961 Frederick et al.
3,644,055 A 2/1972 Davis
3,719,430 A 3/1973 Blair et al.
3,860,360 A 1/1975 Yu
3,861,826 A 1/1975 Dean
3,876,328 A 4/1975 Exley
3,905,721 A 9/1975 Fitzpatrick
3,936,223 A 2/1976 Baghdadi
4,027,997 A * 6/1977 Bryans ..... F04D 21/00 415/207
4,100,732 A 7/1978 Bryans et al.
4,344,737 A 8/1982 Liu
4,349,314 A 9/1982 Erwin
4,431,374 A 2/1984 Benstein et al.
4,576,550 A 3/1986 Bryans
4,824,325 A 4/1989 Bandukwalla
4,877,373 A 10/1989 Bandukwalla
4,938,661 A 7/1990 Kobayashi et al.
5,178,516 A 1/1993 Nakagawa et al.
5,316,441 A 5/1994 Osborne
5,362,203 A 11/1994 Brasz
5,564,898 A 10/1996 Richards et al.
5,623,827 A * 4/1997 Monty ..... F23R 3/10 60/747
5,704,211 A 1/1998 Hatfield
6,123,506 A 9/2000 Brand et al.
6,155,779 A 12/2000 Watanabe et al.
6,279,322 B1 * 8/2001 Moussa ..... F04D 29/444 60/751
6,442,940 B1 9/2002 Young et al.
6,471,475 B1 10/2002 Sasu et al.
6,540,481 B2 * 4/2003 Moussa ..... F04D 29/441 415/208.2
6,546,733 B2 * 4/2003 North ..... F23R 3/002 60/772
6,554,569 B2 4/2003 Decker et al.
6,589,015 B1 7/2003 Roberts et al.
6,695,579 B2 2/2004 Meng
6,834,501 B1 12/2004 Vrbas et al.
7,025,566 B2 4/2006 Sasu et al.
7,032,383 B2 4/2006 Weber
7,094,024 B2 8/2006 Nguyen et al.
7,101,151 B2 9/2006 Loringer et al.
7,407,367 B2 8/2008 McAuliffe et al.
7,442,006 B2 10/2008 Nguyen et al.
7,448,852 B2 11/2008 Abdel et al.
7,500,364 B2 3/2009 Schumacher et al.
7,717,672 B2 * 5/2010 Barton ..... F04D 29/624 415/208.2
7,798,777 B2 9/2010 Moussa et al.
7,827,798 B2 11/2010 Commaret et al.
7,862,295 B2 1/2011 Daguenet
7,871,243 B2 1/2011 Chen et al.
7,955,051 B2 6/2011 Daguenet et al.
8,006,497 B2 8/2011 Nolcheff et al.
8,016,557 B2 9/2011 Abdel et al.
8,038,392 B2 10/2011 Honda et al.
8,047,777 B2 11/2011 Commaret et al.
8,087,491 B2 1/2012 Merchant et al.
8,087,880 B2 * 1/2012 Karafillis ..... F01D 11/22 415/118
8,127,551 B2 3/2012 Commaret et al.
8,142,148 B2 3/2012 Hernandez et al.
8,147,186 B2 4/2012 Ibaraki et al.
8,162,604 B2 4/2012 Kuhnel et al.
8,231,341 B2 7/2012 Anderson et al.
8,287,236 B2 10/2012 Nishida et al.
8,425,188 B2 4/2013 Dovbush et al.
8,438,854 B2 5/2013 Nolcheff
8,505,305 B2 8/2013 Ziaei et al.
8,511,981 B2 8/2013 Small et al.
8,540,484 B2 9/2013 Hollman et al.
8,585,348 B2 11/2013 Lin et al.
8,616,841 B2 12/2013 Johnson
8,616,843 B2 12/2013 Shibata et al.
8,839,625 B2 9/2014 Napier et al.
9,228,497 B2 1/2016 Ottow et al.
9,291,171 B2 3/2016 Bunel et al.
9,512,733 B2 12/2016 Lombard et al.
9,581,170 B2 2/2017 Holbrook
9,631,814 B1 4/2017 Barton et al.
9,726,032 B2 8/2017 Ress et al.
9,874,220 B2 1/2018 Adams
10,087,950 B2 * 10/2018 Nakaniwa ..... F04D 29/053
10,208,628 B2 2/2019 Nasir et al.
10,267,179 B2 * 4/2019 Manning ..... F04D 29/701
10,330,121 B2 6/2019 Reynolds et al.
10,352,237 B2 7/2019 Mazur et al.
10,422,345 B2 * 9/2019 Parker ..... F04D 17/10
10,718,222 B2 * 7/2020 King ..... B22F 5/10
2002/0146320 A1 * 10/2002 Moussa ..... F04D 29/441 415/208.3
2005/0163610 A1 7/2005 Higashimori
2007/0036646 A1 2/2007 Nguyen et al.
2007/0113557 A1 5/2007 Schumacher et al.
2007/0183890 A1 8/2007 Nolcheff et al.
2009/0047127 A1 2/2009 Commaret et al.
2009/0293485 A1 12/2009 Nolcheff et al.
2009/0304502 A1 12/2009 Nolcheff
2012/0014788 A1 * 1/2012 Blair ..... F04D 25/163 415/208.2
2012/0272663 A1 * 11/2012 Moussa ..... F04D 29/30 60/805
2013/0309082 A1 * 11/2013 Sugimura ..... F01D 1/06 415/211.2
2015/0308453 A1 * 10/2015 Nakaniwa ..... F04D 29/444 415/59.1
2016/0003149 A1 1/2016 Suciu et al.
2016/0053774 A1 * 2/2016 Tarnowski ..... F04D 29/444 415/207
2016/0061212 A1 3/2016 Mokulys et al.
2016/0061219 A1 3/2016 Mokulys et al.
2016/0115971 A1 4/2016 Duong et al.
2017/0102005 A1 4/2017 Schuldt et al.
2017/0248155 A1 * 8/2017 Parker ..... F02C 3/08
2017/0292536 A1 10/2017 Konig
2017/0362947 A1 12/2017 Nasir et al.
2018/0135516 A1 5/2018 Nasir et al.
2018/0216629 A1 8/2018 Benetschik et al.
2018/0258959 A1 9/2018 Honda et al.
2018/0274376 A1 * 9/2018 King ..... B33Y 80/00
2019/0162191 A1 5/2019 Lesser et al.
2019/0226493 A1 * 7/2019 Choi ..... F04D 29/444
2019/0264705 A1 8/2019 Higashimori et al.

FOREIGN PATENT DOCUMENTS

FR 2927950 A1 * 8/2009 ..... F04D 29/441
FR 3024887 12/2018
WO WO-2009115690 A1 * 9/2009 ..... F02C 3/08
WO 2016001364 1/2016
WO 2016057112 A1 4/2016
WO 2017129342 8/2017
WO 2018205631 11/2018
WO 2019063384 4/2019

OTHER PUBLICATIONS

Extended European Search Report, European Application No. 20162642.1-1007, dated Jul. 21, 2020, 9 pages.

* cited by examiner

DESWIRLER ASSEMBLY FOR A CENTRIFUGAL COMPRESSOR

BACKGROUND

Centrifugal compressors are used in rotating machines to pressurize a fluid. A typical centrifugal compressor comprises an impeller coupled to a rotatable shaft. Fluid exiting a rotating impeller is at a high Mach number and dynamic pressure. For certain applications, such as a gas turbine engine having a centrifugal compressor discharging pressurized air to a combustion chamber, the fluid exiting a rotating impeller must be diffused prior to being used in an application.

SUMMARY

According to some aspects of the present disclosure, a diffuser assembly is disclosed for conditioning the effluent of a centrifugal compressor. The centrifugal compressor has an axis of rotation. The diffuser assembly comprises an annular conduit, a first set of vanes, and a second set of vanes. The annular conduit comprises a first wall and a second wall, the first and second wall displaced from each other and cooperating to define an inlet, an outlet, and a fluid passage extending from the inlet to the outlet. The fluid passage comprises a first passage portion, a second passage portion, and a third passage portion. The first passage portion extends radially outward from the inlet and defined between a first portion of the first wall and a first portion of the second wall. The first portions of the first and second walls are linear and parallel in axial cross section along the length of the first passage portion. The second passage portion extends from the first passage portion and is defined between a second portion of the first wall and a second portion of the second wall. The second portions of the first and second walls are curved in an axial dimension in axial cross section. The third passage portion extends from the second passage portion and is defined between a third portion of the first wall and a third portion of the second wall. The third portions of the first and second wall are linear in axial cross section and spaced apart at an increasing distance along the length of the third passage portion. The first set of vanes are positioned in the first passage portion. The second set of vanes are positioned in the second passage portion. Each of the vanes of the second set of vanes comprises a pressure surface and a suction surface extending from a leading edge to a trailing edge of the vane. The pressure and suction surfaces each curve in an axial and lateral dimension.

In some embodiments each of the vanes of the first set of vanes curve in a lateral dimension. In some embodiments each of the vanes of the first set of vanes curve about a respective radius extending perpendicular to the axis of rotation. In some embodiments the second portions of the first and second walls are spaced apart by the same distance along the length of the second passage portion. In some embodiments the second portions of the first and second walls are spaced apart at a decreasing distance along the length of the second passage portion.

In some embodiments the inlet is positioned to receive the effluent of the centrifugal compressor. In some embodiments the outlet is positioned to direct fluid exiting the deswirler assembly to a combustion chamber. In some embodiments one or more vanes of the second set of vanes have a length greater than two thirds of the length of the second passage portion. In some embodiments one or more vanes of the first set of vanes have a length greater than three quarters of the length of the first passage portion.

According to further aspects of the present disclosure, a diffuser assembly is disclosed for conditioning the effluent of a centrifugal compressor having an axis of rotation. The diffuser assembly comprises an annular conduit, a first set of vanes, and a second set of vanes. The annular conduit comprises a first wall and a second wall displaced from each other and cooperating to define an inlet, an outlet, and a passage extending from the inlet to the outlet. The passage comprises a first linear portion, a curved portion, and a second linear portion. The first set of vanes are positioned in the first linear portion of the passage. The first linear portion is defined between radially extending portions of the first wall and second wall. Each vane of the first set of vanes curves from a first leading edge to a first trailing edge. The second set of vanes are positioned in the curved portion of the passage. The curved portion is defined by an axially aft curve of the first and second walls. Each vane of the second set of vanes curves axially and laterally from a second leading edge facing the linear portion of the passage to a second trailing edge.

In some embodiments each vane of the first set of vanes curves about a respective radius extending perpendicular to the axis of rotation. In some embodiments each vane of the first set of vanes curves laterally from the first leading edge facing the inlet to the first trailing edge facing the curved portion of the passage. In some embodiments the second linear portion is defined between portions of the first and second wall being linear in axial cross section and spaced apart at an increasing distance along the length of the second linear portion. In some embodiments the second linear portion is defined between portions of the first and second wall being linear and parallel in axial cross section.

According to still further aspects of the present disclosure, a method is disclosed for conditioning a fluid exiting a centrifugal compressor having an axis of rotation. The method comprises passing the fluid through a first linear portion of an annular conduit, the first linear portion defined between radially extending and parallel portions of a first conduit wall and a second conduit wall, the first linear portion comprising a plurality of first vanes extending between the first conduit wall to the second conduit wall; and passing the fluid through a curved portion of the annular conduit after the fluid is passed through the first linear portion, the curved portion defined between axially curved portions of the first conduit wall and the second conduit wall, the curved portion comprising a plurality of second vanes extending between the first conduit wall and the second conduit wall, wherein each vane of the plurality of second vanes curves in an axial and a lateral dimension.

In some embodiments the method further comprises passing the fluid through a flared portion of the annular conduit after the fluid is passed through the curved portion, the flared portion defined between linear portions of the first conduit wall and the second conduit wall spaced apart at an increasing distance along the length of the flared portion. In some embodiments the method further comprises passing the fluid through a second linear portion of the annular conduit after the fluid is passed through the curved portion, the second linear portion defined between linear portions of the first conduit wall and the second conduit wall spaced apart at the same distance along the length of the second linear portion.

In some embodiments the method further comprises discharging the fluid to a combustion chamber after the fluid is passed through the first linear portion and the curved portion. In some embodiments the method further comprises discharging the fluid from the centrifugal compressor in a radially outward direction prior to passing the fluid through the first linear portion. In some embodiments the method further comprises positioning the first linear portion to receive the effluent of a centrifugal compressor.

BRIEF DESCRIPTION OF THE DRAWINGS

The following will be apparent from elements of the figures, which are provided for illustrative purposes.

Figure 1:
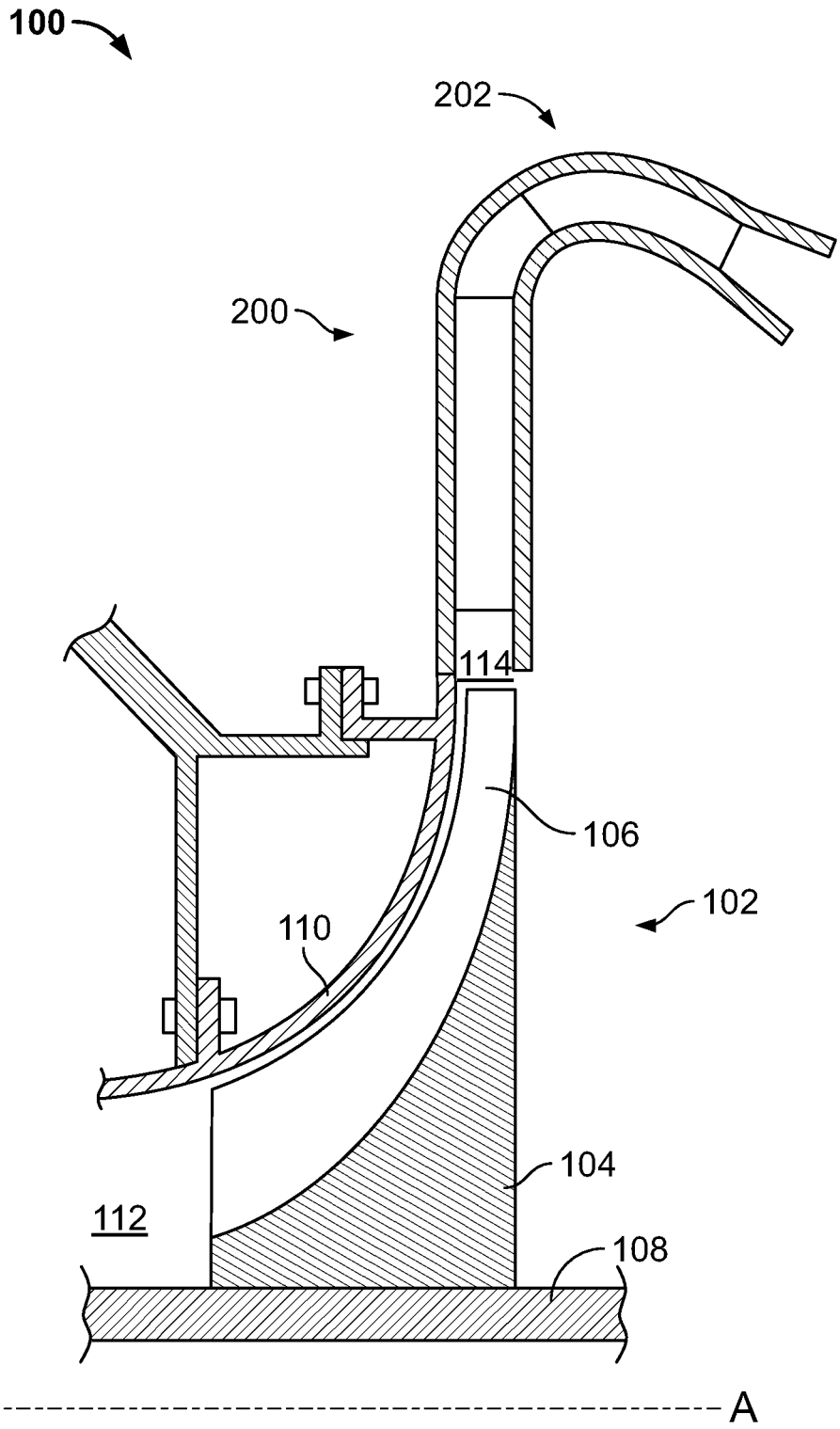
FIG. 1 is a schematic cross sectional view of a diffuser assembly and centrifugal compressor in accordance with some embodiments of the present disclosure.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

A typical diffuser used to slow the velocity of a fluid exiting a centrifugal compressor comprises a set of static vanes positioned at the outlet of the centrifugal compressor, a flowpath turn from a generally radial direction to a generally axial direction, and a set of deswirl vanes. Since space in modern rotating machines such as gas turbine engines is at a premium, advances are desired to sufficiently diffuse the fluid exiting a centrifugal compressor while reducing the space requirements of the diffuser.

The present disclosure is therefore directed to systems and methods of diffusing and/or deswirling a fluid exiting from a centrifugal compressor while reducing the space requirements or footprint of the diffuser. More specifically, the present disclosure is generally directed to a diffuser of a centrifugal compressor having a first set of vanes positioned in a radial portion of the diffuser conduit and a second set of vanes positioned in a turn of the diffuser conduit.

Figure 2:
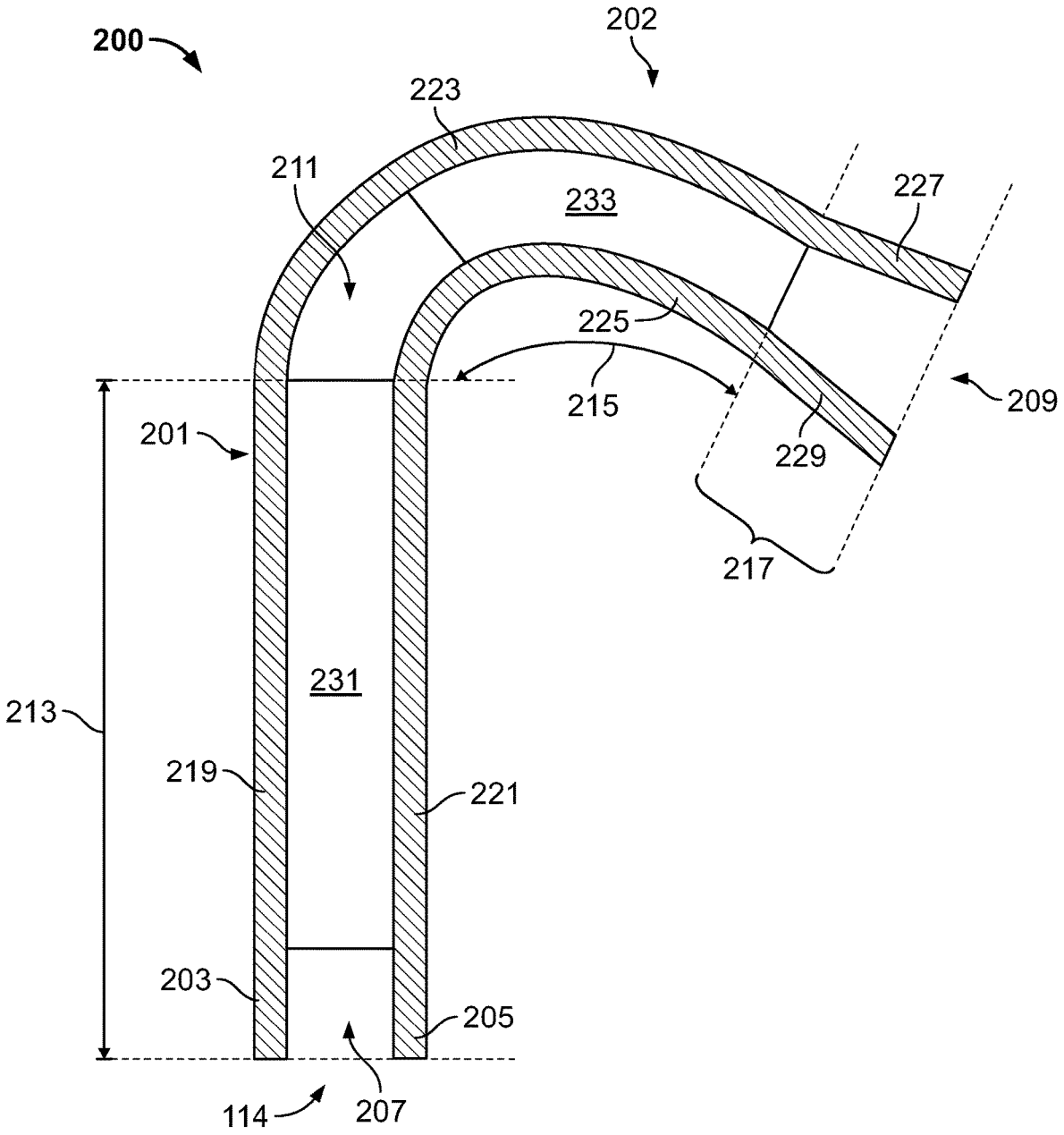
FIG. 2 is a schematic cross sectional view of a diffuser assembly in accordance with some embodiments of the present disclosure.

FIG. 1 provides a schematic cross sectional view of a system 100 comprising a centrifugal compressor 102 and a diffuser assembly 200. FIG. 2 provides a more detailed schematic cross sectional view of the diffuser assembly 200. The diffuser assembly 200 may include a deswirler assembly 202.

Centrifugal compressor 102 may comprise an impeller 104 affixed to a rotatable shaft 108 that defines an axis of rotation A. A plurality of blades 106 may extend radially outward from the impeller 104. The centrifugal compressor 102 may further comprise a shroud 110 that at least partly encases the impeller 104. During operation, fluid flows into the centrifugal compressor 102 at a compressor inlet 112, between the rotating blades 106, and exits the centrifugal compressor 102 at a compressor outlet 114. The centrifugal compressor 102 may be part of a larger rotatable machine, such as a gas turbine engine.

A diffuser assembly 200 may be positioned to receive the effluent of the centrifugal compressor 102. The diffuser assembly 200 may condition or treat the effluent, or fluid discharged from the centrifugal compressor 102. The diffuser assembly 200 may comprise an annular conduit 201 and two sets of vanes 231, 233 positioned in the conduit 201.

The annular conduit 201 may comprise a first wall 203 and a second wall 205. First wall 203 and second wall 205 may be annular. First wall 203 and second wall 205 are displaced from each other and may together define a fluid passage 211. First wall 203 and second wall 205 may be axially displaced from each other. First wall 203 and second wall 205 may define a diffuser inlet 207 and diffuser outlet 209. The fluid passage 211 may extend from the diffuser inlet 207 to the diffuser outlet 209.

The annular conduit 201 may be positioned to receive fluid discharged in a radial direction from the centrifugal compressor 102. The diffuser inlet 207 may be adjacent the compressor outlet 114. The annular conduit 201 may be positioned with the diffuser inlet 207 radially outward of the compressor outlet 114. The annular conduit 201 may be positioned to receive the effluent of the centrifugal compressor 102.

The fluid passage 211 may comprise three passage portions. A first passage portion 213, also referred to as a linear portion or first linear portion, may extend radially outward from the diffuser inlet 207 and may be defined between a first portion 219 of the first wall 203 and a first portion 221 of the second wall 205. As shown in FIG. 2, the first portions 219, 221 may be linear and parallel in axial cross section along the length of the first passage portion 213. The first portion 219 and first portion 221 may be spaced apart at an equal distance along the length of the first passage portion 213. The first passage portion 213 may therefore having a constant axial dimension along its radial length, with an increasing circumference of the annular passage.

A first set of vanes 231 may be positioned in the first passage portion 213. In some embodiments, each vane of the first set of vanes 231 may curve in a lateral dimension. In some embodiments, each vane of the first set of vanes 231 may curve about a radius extending perpendicular to the axis of rotation A. The first set of vanes 231 may be referred to as diffuser vanes. One or more vanes of the first set of vanes 231 may have a length that is greater than half of the length of the first passage portion 213. In some embodiments, one or more vanes of the first set of vanes 231 may have a length that is greater than three quarters of the length of the first passage portion 213.

A second passage portion 215 or curved portion may extend from the first passage portion 213. The second passage portion 215 may be defined between a second portion 223 of the first wall 203 and a second portion 225 of the second wall 205. As shown in FIG. 2, the second portions 223, 225 may curve in an axial dimension in axial cross section and be spaced apart by the same distance along the length of the second passage portion 215. In some embodiments, the second portions 223, 225 may curve in an axial dimension in axial cross section and may be spaced apart at a decreasing distance along the length of the second passage portion 215.

Figure 3:
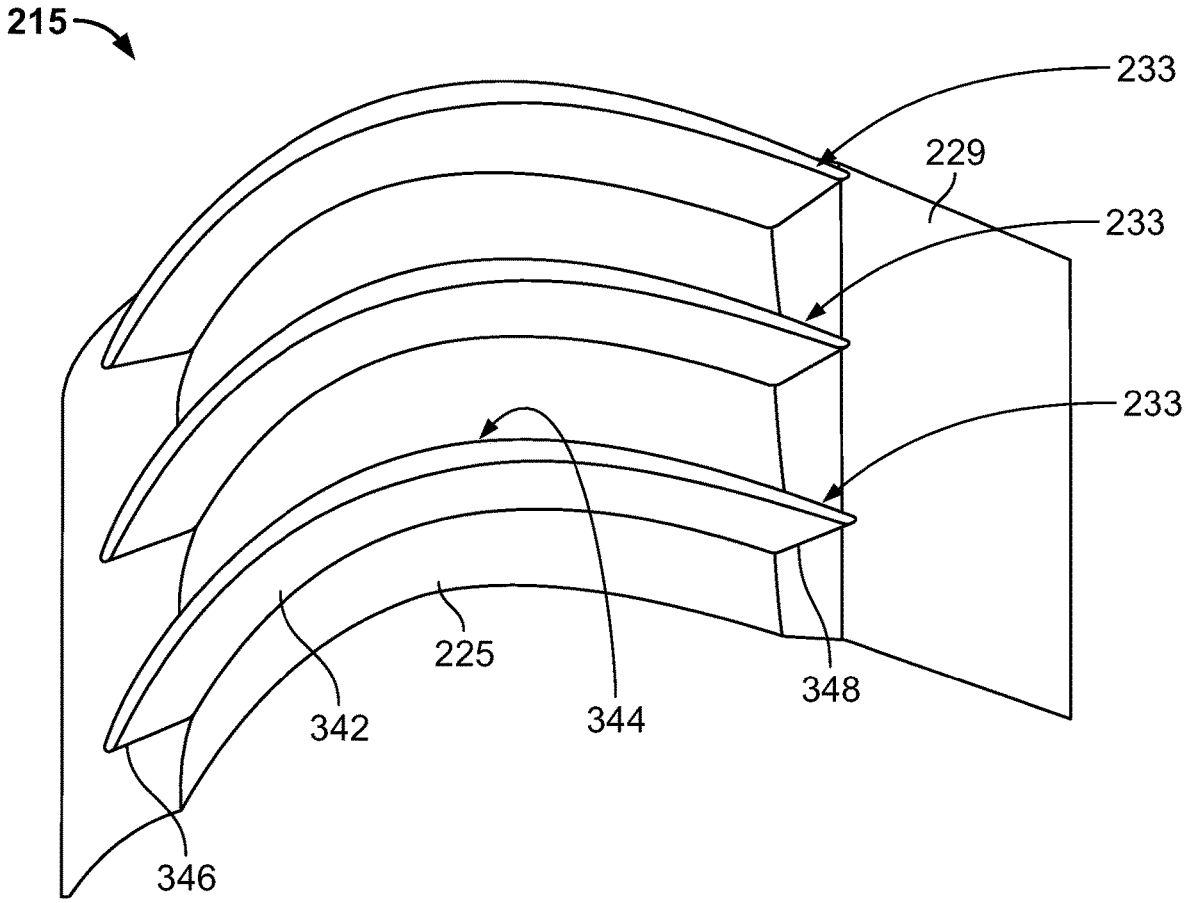
FIG. 3 is an isometric view of a portion of vanes of a deswirler assembly in accordance with some embodiments of the present disclosure.
Figure 4:
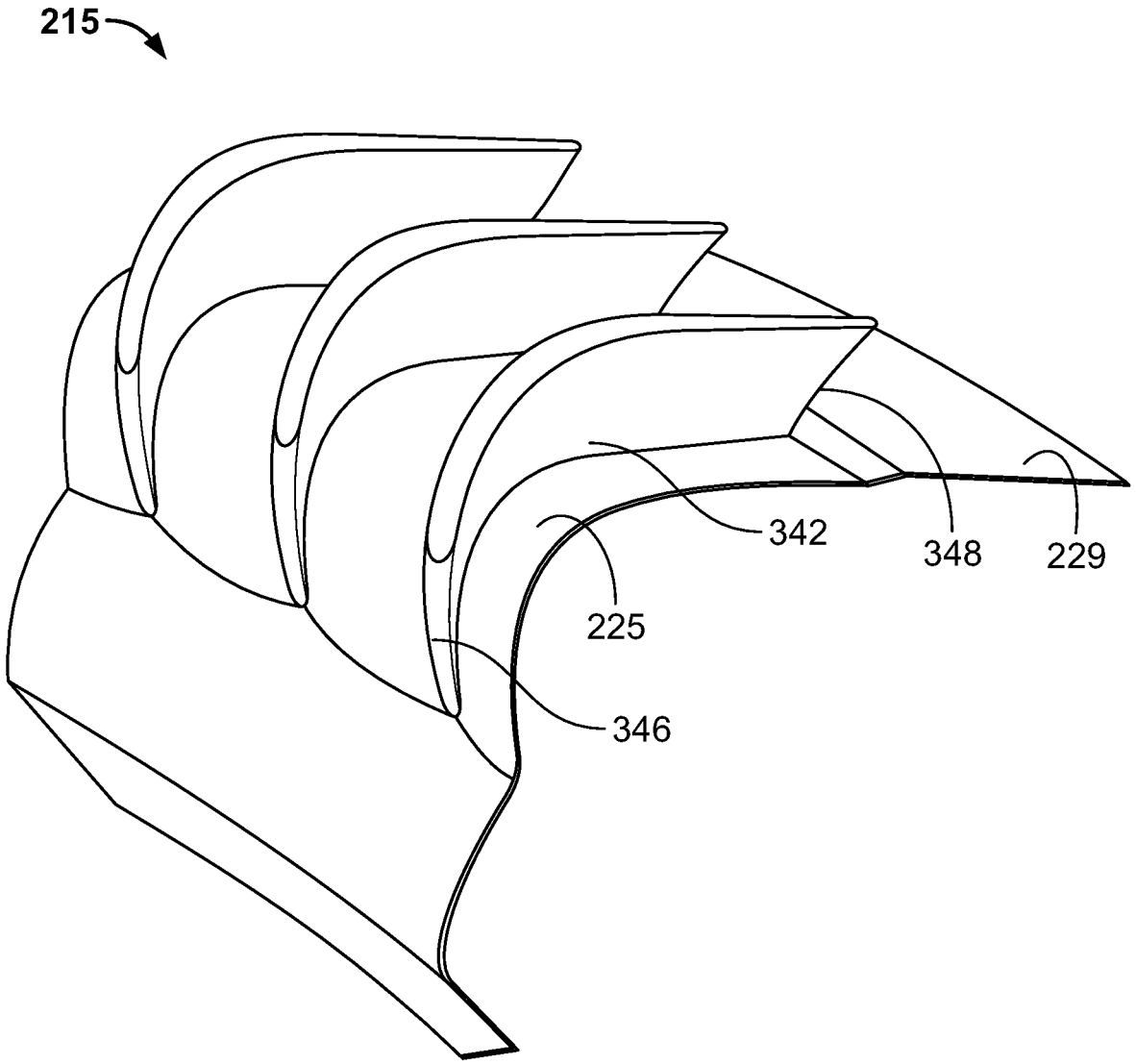
FIG. 4 is an isometric view of a portion of vanes of a deswirler assembly in accordance with some embodiments of the present disclosure.
Figure 5:
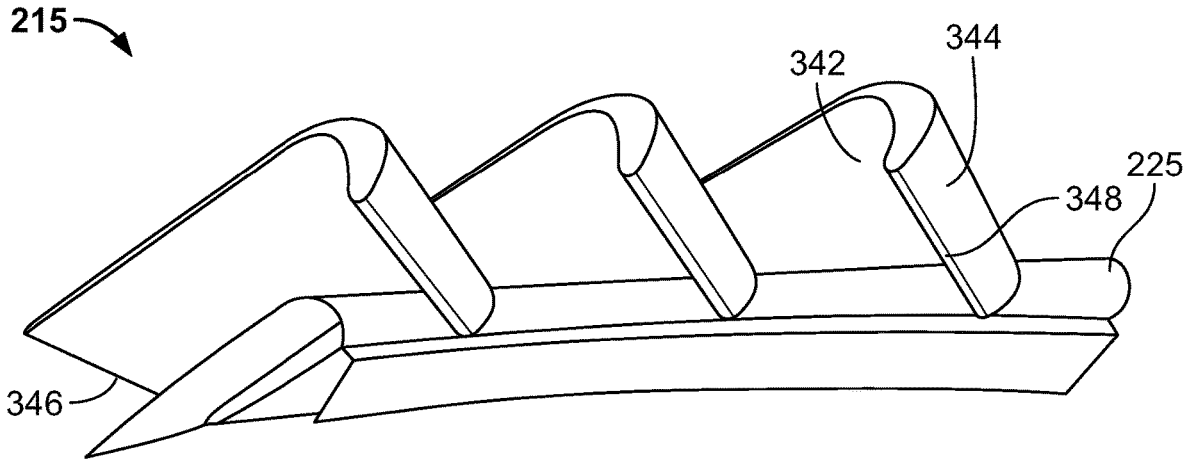
FIG. 5 is an isometric view of a portion of vanes of a deswirler assembly in accordance with some embodiments of the present disclosure.

A second set of vanes 233 may be positioned in the second passage portion 215. FIGS. 3, 4, and 5 each provide isometric views of a portion of the second set of vanes 233. Each vane of the second set of vanes 233 may extend between the second portion 223 of the first wall 203 and the second portion 225 of the second wall 205. Each vane of the second set of vanes 233 may comprise a pressure surface 342 and a suction surface 344 each extending from a leading edge 346 to a trailing edge 348. In some embodiments, the pressure surface 342 and suction surface 344 of each vane of the second set of vanes 233 may curve in an axial and lateral dimension. One or more vanes of the second set of vanes 233 may have a length that is greater than half of the length of the second passage portion 215. In some embodiments, one more vanes of the second set of vanes 233 may have a length that is greater than two thirds of the length of the second passage portion 215. As best seen in FIG. 5, in some embodiments one or more vanes of the second set of vanes 233 may lean relative to second wall 205, which is to say that the vanes 233 may be angled with respect to the second wall 205 and/or a plane of the axis of rotation A.

A third passage portion 217 may extend from the second passage portion 215 and may be referred to as a flared portion or a second linear portion. The third passage portion 217 may be defined between a third portion 227 of the first wall 203 and a third portion 229 of the second wall 205. The third portions 227, 229 may be linear in axial cross section. In some embodiments, the third portions 227, 229 may be spaced apart at the same distance along the length of the third passage portion 217. As shown in FIG. 2, in other embodiments the third portions 227, 299 may be spaced apart at an increasing distance along the length of the third passage portion 217 resulting in a flared portion.

The deswirler assembly 202 may comprise the second passage portion 215 and the third passage portion 217.

Following the third passage portion 217, the annular conduit 201 may terminate with a diffuser outlet 209. The diffuser outlet 209 may discharge conditioned effluent of a centrifugal compressor 102. The diffuser outlet 209 may discharge a fluid conditioned by one or both of the first set of vanes 231 and second set of vanes 233 after the fluid was discharged by the centrifugal compressor 102. The diffuser outlet 209 may be positioned to discharge fluid exiting the diffuser assembly 200 to a combustion chamber, or to another application.

Figure 6:
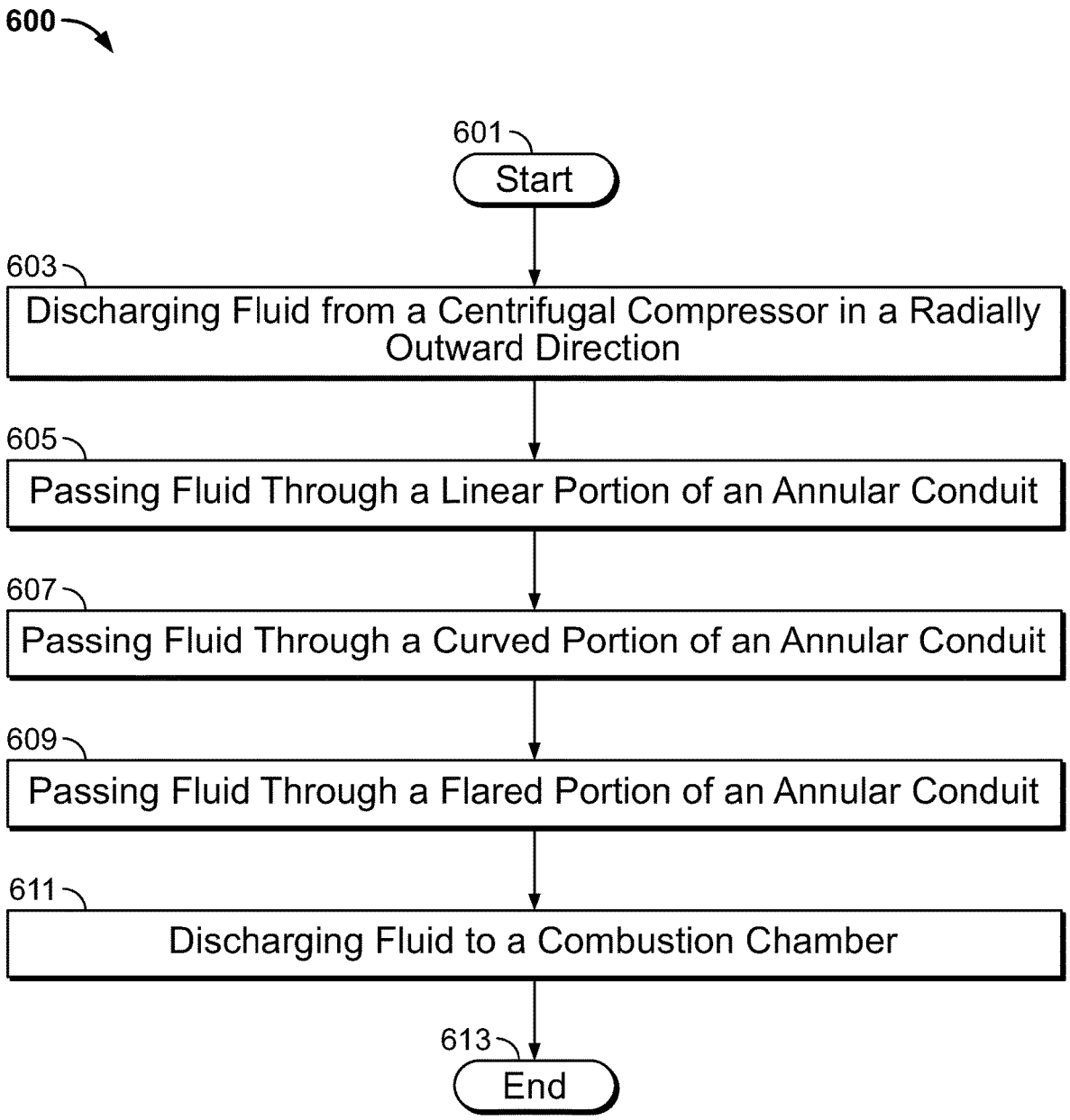
FIG. 6 is a flow diagram of a method in accordance with some embodiments of the present disclosure.

The present disclosure additional provides methods of conditioning or treating the effluent of a centrifugal compressor 102. One such method 600 is presented in the flow diagram of FIG. 6. Method 600 starts at Block 601. The steps of method 600, presented at Blocks 601 through 613, may be performed in the order presented in FIG. 6 or in another order. One or more steps of the method 600 may not be performed.

At Block 603 fluid may be discharged from a centrifugal compressor 102. The fluid may exit the centrifugal compressor 102 at a compressor outlet 114. The fluid may exit the centrifugal compressor 102 in a radially outward direction. The fluid may enter a diffuser assembly 200 upon discharge from the centrifugal compressor 102. The step performed at Block 603 may further comprise positioning a first linear portion 213 of an annular conduit 201 of a diffuser assembly 200 to receive fluid exiting from a centrifugal compressor 102.

At Block 605 the fluid exiting the centrifugal compressor 102 may be passed through a first linear portion 213 of an annular conduit 201 of a diffuser assembly 200. The first linear portion 213 may be defined between radially extending and parallel portions 219, 221 in axial cross section of a first conduit wall 203 and a second conduit wall 205. The first linear portion 213 may comprise a plurality of first vanes 231 extending between the first conduit wall 203 and the second conduit wall 205. Each vane of the first set of vanes 231 may curve in a lateral dimension or may curve about a radius extending perpendicular to the axis of rotation A. One or more vanes of the first set of vanes 231 may have a length that is greater than half of or three quarters of the length of the first passage portion 213.

At Block 607 the fluid may be passed through a curved portion 215 of the annular conduit 201 after the fluid is passed through the first linear portion 213. The curved portion 215 may be defined between axially curved portions 223, 225 of said first conduit wall 203 and said second conduit wall 205. The curved portion 215 may comprise a plurality of second vanes 233 extending between the first conduit wall 203 and the second conduit wall 205. Each vane of the plurality of second vanes 233 may curve in an axial and a lateral dimension. Each vane of the second set of vanes 233 may comprise a pressure surface 342 and a suction surface 344 each extending from a leading edge 346 to a trailing edge 348. The pressure surface 342 and suction surface 344 of each vane of the second set of vanes 233 may curve in an axial and lateral dimension. One or more vanes of the second set of vanes 233 may have a length that is greater than half of or two thirds of the length of the second passage portion 215.

At Block 609 the fluid may be passed through a flared portion 217 of the annular conduit 201 after the fluid is passed through the curved portion 215. The flared portion 217 may be defined between linear portions 227, 229 of said first conduit wall 203 and said second conduit wall 205. The linear portions 227, 229 may be spaced apart at an increasing distance in axial cross section along the length of the flared portion 217. In some embodiments the step at Block 609 may be performed by passing the fluid through a second linear portion rather than a flared portion. The second linear portion may be defined between linear portions 227, 229 that are parallel in axial cross section.

At Block 611 the fluid may be discharged from the annular conduit 201 and/or the diffuser assembly 200. The fluid may be discharged to a combustion chamber. The fluid may be discharged after the fluid is passed through the first linear portion 213 and the curved portion 215.

Method 600 ends at Block 613.

The disclosed diffuser assembly 200 may be manufactured as more than one constituent pieces, or may be cast as a single piece for multiple constituent pieces.

The presently disclosed systems and methods provide advantages over prior art systems and methods of diffusing and/or deswirling fluid exiting a centrifugal compressor. Notably, the presently disclosed diffuser assembly occupies less space, particularly in an axial dimension, than prior art systems. While maintaining similar diffusing and/or deswirling properties, the presently disclosed systems and methods free space that may allow for a smaller overall engine, alternative uses for the space, and/or a lighter overall engine. Bringing the deswirler vanes forward into the turn of the diffuser assembly frees additional space to include a third passage portion that reduces dump losses in the system. These reduced dump losses may be sufficient to offset any increases in losses through the deswirler vanes themselves.

Although examples are illustrated and described herein, embodiments are nevertheless not limited to the details shown, since various modifications and structural changes may be made therein by those of ordinary skill within the scope and range of equivalents of the claims.

What is claimed is:

1. A diffuser assembly for conditioning the effluent of a centrifugal compressor having an axis of rotation, said diffuser assembly comprising:

an annular conduit comprising a first wall and a second wall, the first and second wall displaced from each other and cooperating to define an inlet, an outlet, and a fluid passage extending from the inlet to the outlet, said fluid passage comprising:

a first passage portion extending radially outward from the inlet and defined between a first portion of the first wall and a first portion of the second wall, the first portions of the first and second walls being linear and parallel in axial cross section along the length of the first passage portion;

a second passage portion extending from the first passage portion, the second passage portion defined between a second portion of the first wall and a second portion of the second wall, the second portions of the first and second walls being curved in an axial dimension in axial cross section, and wherein the second portions of the first and second walls are spaced apart at a decreasing distance along a length of the second passage portion; and a third passage portion extending from the second passage portion, the third passage portion defined between a third portion of the first wall and a third portion of the second wall, the third portions of the first and second wall being linear in axial cross section and spaced apart at an increasing distance along the length of the third passage portion;

a first set of vanes positioned in the first passage portion, each vane of the first set of vanes curving from a first leading edge to a first trailing edge spaced apart from the first leading edge; and a second set of vanes positioned in the second passage portion that each extend between the second portions of the first and second walls at an angle relative to the second wall, each of the vanes of the second set of vanes comprising a pressure surface and a suction surface extending from a second leading edge to a second trailing edge of the vane, wherein the pressure and suction surfaces each curve in an axial and lateral dimension and the second leading edge of each vane of the second set of vanes is spaced apart radially from the first trailing edge of each vane of the first set of vanes to define a gap radially therebetween.

2. The diffuser assembly of claim 1 wherein said inlet is positioned to receive the effluent of the centrifugal compressor.

3. The diffuser assembly of claim 2 wherein said outlet is positioned to direct fluid exiting the diffuser assembly to a combustion chamber.

4. The diffuser assembly of claim 1 wherein one or more vanes of the second set of vanes have a length greater than two thirds of the length of the second passage portion.

5. The diffuser assembly of claim 1 wherein one or more vanes of the first set of vanes have a length greater than three quarters of the length of the first passage portion.

6. The diffuser assembly of claim 1 wherein the gap extends circumferentially about the axis of rotation and the gap is free of any vanes.

7. A diffuser assembly for conditioning the effluent of a centrifugal compressor having an axis of rotation, said diffuser assembly comprising:

an annular conduit comprising a first wall and a second wall, the first and second wall displaced from each other and cooperating to define an inlet, an outlet, and a passage extending from the inlet to the outlet, said passage comprising a first linear portion, a curved portion, and a second linear portion;

a first set of vanes positioned in the first linear portion of said passage, the first linear portion defined between radially extending portions of the first wall and second wall, each vane of the first set of vanes curving from a first leading edge to a first trailing edge; and a second set of vanes positioned in the curved portion of the passage, the curved portion defined by an axially aft curve of the first and second walls that extends between and interconnects the first linear portion and the second linear portion, each vane of the second set of vanes curving axially and laterally from a second leading edge facing the first linear portion of the passage to a second trailing edge, wherein the second leading edge of each vane of the second set of vanes is spaced apart radially from the first trailing edge of each vane of the first set of vanes to define a gap radially therebetween, and wherein the first and second walls in the curved portion of the passage are spaced apart at a decreasing distance along a length of the curved portion.

8. The diffuser assembly of claim 7 wherein each vane of said first set of vanes curves laterally from the first leading edge facing the inlet to the first trailing edge facing the curved portion of the passage.

9. The diffuser assembly of claim 7 wherein the second linear portion is defined between portions of the first and second wall being linear in axial cross section and spaced apart at an increasing distance along the length of the second linear portion.

10. The diffuser assembly of claim 7 wherein the second linear portion is defined between portions of the first and second wall being linear and parallel in axial cross section.

11. The diffuser assembly of claim 7 wherein the gap is free of any vanes.

12. The diffuser assembly of claim 7 wherein each vane of the second set of vanes extend from the second wall to the first wall at an angle relative to the second wall.

13. A method of conditioning a fluid exiting a centrifugal compressor having an axis of rotation, said method comprising:

passing said fluid through a first linear portion of an annular conduit, the first linear portion defined between radially extending and parallel portions of a first conduit wall and a second conduit wall, the first linear portion comprising a plurality of first vanes extending between the first conduit wall and the second conduit wall; and passing said fluid through a curved portion of said annular conduit after said fluid is passed through said first linear portion, the curved portion defined between axially curved portions of said first conduit wall and said second conduit wall, the curved portion comprising a plurality of second vanes extending between the first conduit wall and the second conduit wall, wherein each vane of the plurality of second vanes curves in an axial and a lateral dimension, and wherein a leading edge of each vane of the plurality of second vanes is spaced apart radially from a trailing edge of each vane of the plurality of first vanes to define a gap radially between the leading edge and the trailing edge, and wherein the axially curved portions of said first conduit wall and said second conduit wall of the curved portion are spaced apart at a decreasing distance along a length of the curved portion.

14. The method of claim 13 further comprising:

passing said fluid through a flared portion of said annular conduit after said fluid is passed through said curved portion, the flared portion defined between linear portions of said first conduit wall and said second conduit wall spaced apart at an increasing distance along the length of the flared portion.

15. The method of claim 13 further comprising:

passing said fluid through a second linear portion of said annular conduit after said fluid is passed through said curved portion, the second linear portion defined between linear portions of said first conduit wall and said second conduit wall spaced apart at the same distance along the length of the second linear portion.

16. The method of claim 13 further comprising:

discharging the fluid to a combustion chamber after said fluid is passed through said first linear portion and said curved portion.

17. The method of claim 13 further comprising:

discharging said fluid from said centrifugal compressor in a radially outward direction prior to passing said fluid through said first linear portion.

18. The method of claim 13 further comprising:

positioning said first linear portion to receive the effluent of a centrifugal compressor.

* * * * *